US006645089B2

(12) United States Patent
Tsunoda et al.

(10) Patent No.: US 6,645,089 B2
(45) Date of Patent: Nov. 11, 2003

(54) GOLF BALL

(75) Inventors: Masaya Tsunoda, Kobe (JP); Jun Ochi, Kobe (JP); Kouhei Takemura, Kobe (JP); Masahide Onuki, Kobe (JP); Masahiko Ueda, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 09/906,132

(22) Filed: Jul. 17, 2001

(65) Prior Publication Data

US 2002/0042308 A1 Apr. 11, 2002

(30) Foreign Application Priority Data

Aug. 1, 2000 (JP) ..... 2000-232629

(51) Int. Cl.[7] ..... A63B 37/00

(52) U.S. Cl. ..... 473/371; 473/351; 473/361; 473/364; 473/376

(58) Field of Search ..... 473/351, 364, 473/361, 371, 376

(56) References Cited

U.S. PATENT DOCUMENTS 2,258,333 A * 10/1941 Miller ..... 473/364
4,714,253 A * 12/1987 Nakahara et al. ..... 473/373
5,688,595 A * 11/1997 Yamagishi et al. ..... 428/375
5,967,907 A * 10/1999 Takemura et al. ... 273/DIG. 22
6,030,296 A * 2/2000 Morgan et al. ..... 473/361
6,096,830 A * 8/2000 Takemura et al. ..... 525/192
6,227,987 B1 * 5/2001 Kato ..... 473/373
6,354,966 B1 * 3/2002 Takemura et al. ..... 473/374
6,461,251 B1 * 10/2002 Yamagishi et al. ..... 473/376
2002/0019268 A1 * 2/2002 Tsunoda et al. ..... 473/351

FOREIGN PATENT DOCUMENTS

GB 2317834 A * 4/1998 ..... A63B/37/00
GB 2321021 A * 7/1998 ..... A63B/37/00

OTHER PUBLICATIONS

Analysis of Mechanism of Golf Ball Spinning During Impact. Tsunoda, et al, (4 pages).

* cited by examiner

*Primary Examiner*—Derris H. Banks
*Assistant Examiner*—Dmitry Suhol
(74) *Attorney, Agent, or Firm*—Birch, Stewart, Kolasch & Birch, LLP

(57) ABSTRACT

A golf ball (1) comprises a core (3) and a cover (5). The core (3) has a six-layer structure having first to sixth layers (7) to (17). A value of (T1/T2) is greater than 2.10 and is equal to or smaller than 2.50, wherein time series data on force in a z direction which is applied to a load cell provided on a back face of a collision plate inclined by 22 degrees with respect to a horizontal direction when the golf ball (1) impacts the collision plate at a speed of 35 m/s in a vertically upward direction are represented by Fn(t), time series data on force in an x direction are represented by Ft(t), a time taken after a start of the impact before the Fn(t) is first changed from a positive number to zero is represented by T1 and a time taken after the start of the impact before the Ft(t) is first changed from a positive number to a negative number is represented by T2. The golf ball (1) has a higher back spin rate during hitting on the same conditions than that of a conventional golf ball.

15 Claims, 3 Drawing Sheets

GOLF BALL

BACKGROUND OF THE INVENTION

1. Field of the Invention

The present invention relates to a golf ball and more particularly to an improvement in a spin performance of the golf ball.

2. Description of the Related Art

A golf ball hit with a golf club flies at an obliquely upward launch angle. The launch angle is caused by a loft angle of a head of the golf club. At the time of launch, the golf ball generates a so-called back spin. The back spin is caused by tangential force generated when the golf ball impacts the head having the loft angle. It has been reported that the amount of the back spin is almost proportional to an impulse of the tangential force generated during the impact (Dynamics and Design Conference '98 in Hokkaido, Lecture Articles "Analysis of Spin Generating Mechanism in Impact of Golf").

After hitting, the golf ball flies in the air and falls after a while. A distance between the hitting and the falling is referred to as a carry. Usually, the golf ball rolls over the ground (a fairway, a green or the like) and stops the rolling. The distance between the falling and the stop is referred to as a run or a roll.

In the case of a tee shot, a great flight distance is desirable. Therefore, a golf ball providing a great carry and run is preferred. In the case of a shot aiming at a green (a shot made with an iron golf club in many cases), a golf ball having a small run is preferred. If the run is great, the golf ball falls from the green or the distance between a rest point and a cup is increased so that a subsequent putt is hard to perform. In other words, a golf ball to easily stop on the green is preferred for score-making.

The golf ball flies with a back spin. It tends to stop on the green more easily if a back spin rate is higher. The reason is that the back spin is a rotation in a reverse direction to a direction of a rotation of the rolling golf ball. From this viewpoint, a golf ball to have a higher back spin rate and to easily stop on the green has been developed in respect of a material and a structure.

For example, an attempt to increase a back spin rate has been made on a golf ball comprising a core and a cover by using a flexible material for the cover. Also in this method, however, a golf ball having a sufficient spin performance has not been obtained. If the cover is too flexible, there is a problem in that the cover is severely damaged by an impact on a club head at hitting or an impact on the ground at falling.

An attempt to easily apply a back spin by increasing a hardness of the core has also been made. Also in this method, however, a golf ball having a sufficient spin performance has not been obtained. If the hardness of the core is too high, there is a problem in that a hitting feeling is reduced.

In consideration of such circumstances, it is an object of the present invention to provide a golf ball having a higher back spin rate at hitting on the same conditions than that of a conventional golf ball.

SUMMARY OF THE INVENTION

In order to achieve the above-mentioned object, the present invention provides a golf ball in which a value of (T1/T2) is greater than 2.10 and is equal to or smaller than 2.50, wherein a direction of a counterclockwise rotation by 22 degrees with respect to a vertically upward direction is set to be a z direction, a direction of a counterclockwise rotation by 22 degrees with respect to a horizontally rightward direction is set to be an x direction, time series data on forces in the z and x directions which are applied to a load cell provided on a back face of a collision plate having a surface extended in the x direction when the golf ball impacts the collision plate in the vertically upward direction at a speed of 35 m/s are represented by Fn(t) and Ft (t) respectively, a time taken after a start of the impact before the Fn (t) is first changed from a positive number to zero is represented by T1, and a time taken after the start of the impact before the Ft(t) is first changed from a positive number to a negative number is represented by T2.

The golf ball has the value of (T1/T2) greater than 2.10 and equal to or smaller than 2.50 which is greater than that of a conventional golf ball. Therefore, an impulse of tangential force is increased during hitting as will be described below in detail. Therefore, the golf ball has a high back spin rate. In the case in which the golf ball falls into the green, a run is small. Also in the case in which the golf ball according to the present invention is hit with a middle iron or a long iron which generates a lower back spin rate than that of a short iron, the run can be controlled.

DESCRIPTION OF THE PREFERRED EMBODIMENTS

The present invention will be described below in detail based on a preferred embodiment with reference to the drawings.

Figure 1:
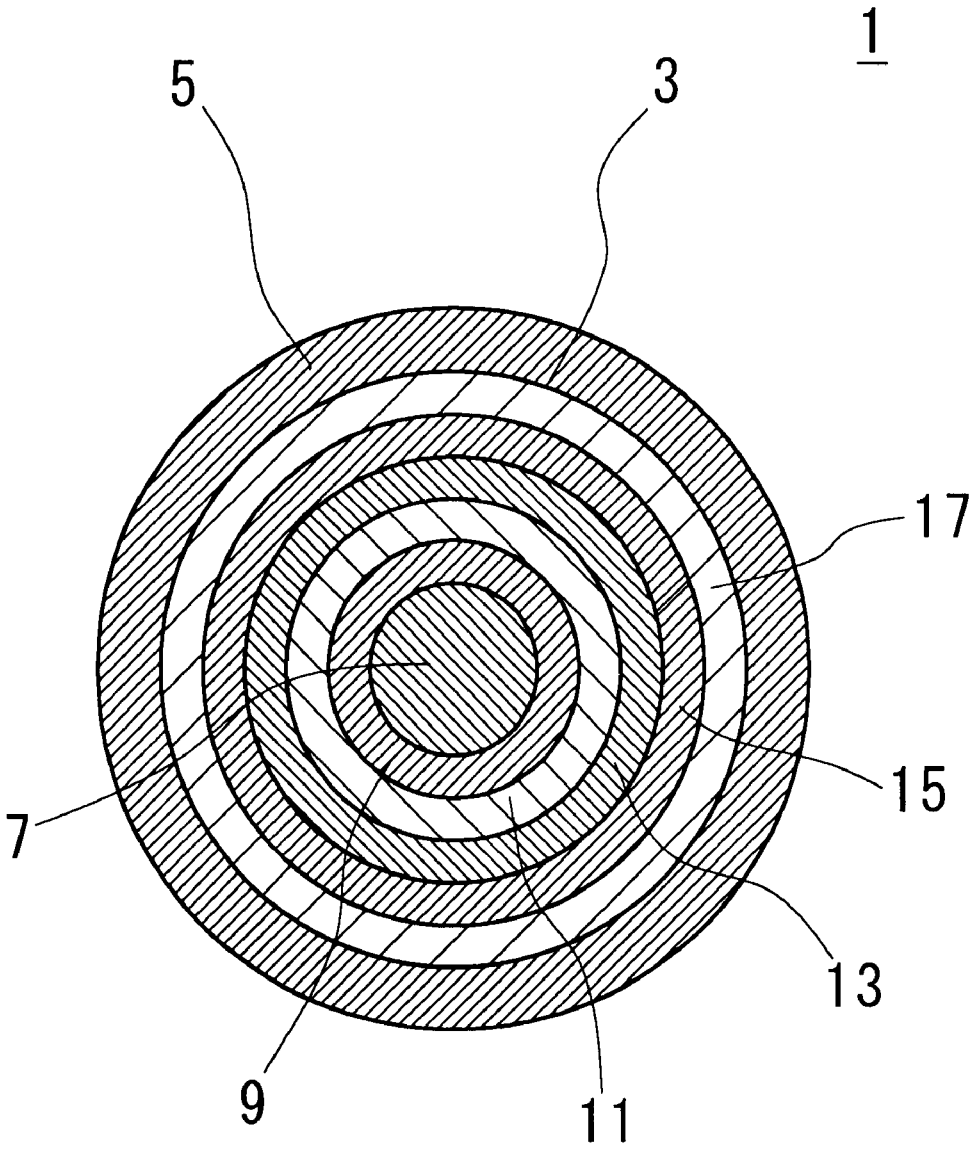
FIG. 1 is a cross section of a golf ball according to an embodiment of the present invention.

As shown in FIG. 1, a golf ball 1 comprises a core 3 and a cover 5. The core 3 includes a first layer 7 which is spherical, a second layer 9 surrounding the first layer 7, a third layer 11 surrounding the second layer 9, a fourth layer 13 surrounding the third layer 11, a fifth layer 15 surrounding the fourth layer 13, and a sixth layer 17 surrounding the fifth layer 15. In other words, the golf ball 1 has a seven-layer structure comprising the core 3 including the six layers and the cover 5. The golf ball 1 is usually provided with a coated layer. The coated layer is not shown in FIG. 1.

The first to sixth layers 7 to 17 are formed by a crosslinked rubber composition. Polybutadiene having a high resilience performance is suitably used for a rubber. In particular, it is preferable that high-cis polybutadiene having cis-1,4 bond of 90% or more should be used. The polybutadiene may be blended with another rubber such as a natural rubber, polyisoprene, a styrene-butadiene copolymer or an ethylene-propylene-diene copolymer. It is preferable that another rubber should be blended in an amount of 50 parts by weight or less based on 100 parts by weight of polybutadiene.

A co-crosslinking agent, organic peroxide and a filler are blended with the rubber composition. A preferable co-crosslinking agent is a metallic salt of α, β—unsaturated carboxylic acid having a carbon number of three to eight. More specifically, a monovalent or bivalent metallic salt of acrylic acid or methacrylic acid is preferable. In particular, zinc acrylate is preferable because the resilience performance of the core 3 can be enhanced. The blending amount of the co-crosslinking agent is regulated so that a modulus of elasticity in each layer is adjusted as will be described below in detail. Consequently, it is possible to obtain the golf ball 1 having a high back spin rate.

Examples of suitable organic peroxide include dicumyl peroxide, 1,1-bis(t-butylperoxy)-3,3,5-trimethylcyclohexane, 2,5-dimethyl-2,5-di(t-butylperoxy)hexane, di-t-butyl peroxide and the like. In particular, the dicumyl peroxide is suitable. The blending amount of the organic peroxide is regulated so that the modulus of elasticity in each layer is adjusted as will be described below in detail. Consequently, it is possible to obtain the golf ball 1 having a high back spin rate.

Examples of the filler include an inorganic filler such as zinc oxide, barium sulfate or calcium carbonate. Moreover, a metal filler having a high specific gravity such as tungsten powder or molybdenum powder may be used. In particular, zinc oxide functioning as an activator is preferable. The blending amount of the filler is regulated so that the modulus of elasticity in each layer is adjusted as will be described below in detail. Consequently, it is possible to obtain the golf ball 1 having a high back spin rate.

Furthermore, an additive such as an antioxidant, apeptizer, an organic sulfur compound or rubber powder may be blended in a proper amount with the rubber composition if necessary.

The core 3 having such layers can be formed by a semi-crosslinking half shell method which will be described below in detail or a rubber injection method.

The cover 5 is formed of a synthetic resin. A preferable synthetic resin is an ionomer resin. An additive such as a pigment (for example, titanium dioxide), a dispersing agent, an antioxidant, a UV absorber or a light stabilizer maybe blended in a proper amount with the cover 5 if necessary. By changing the type or grade of the synthetic resin to be used for the cover 5, the golf ball 1 having a high back spin rate can be obtained as will be described below in detail.

While the golf ball 1 has a seven-layer structure, the number of layers constituting the golf ball 1 is not restricted thereto. While only an outermost layer is formed of a synthetic resin in the golf ball 1, two outer layers (a so-called two-layer cover) may be formed of the synthetic resin. Furthermore, the number of cover layers may be three or more.

Figure 2:
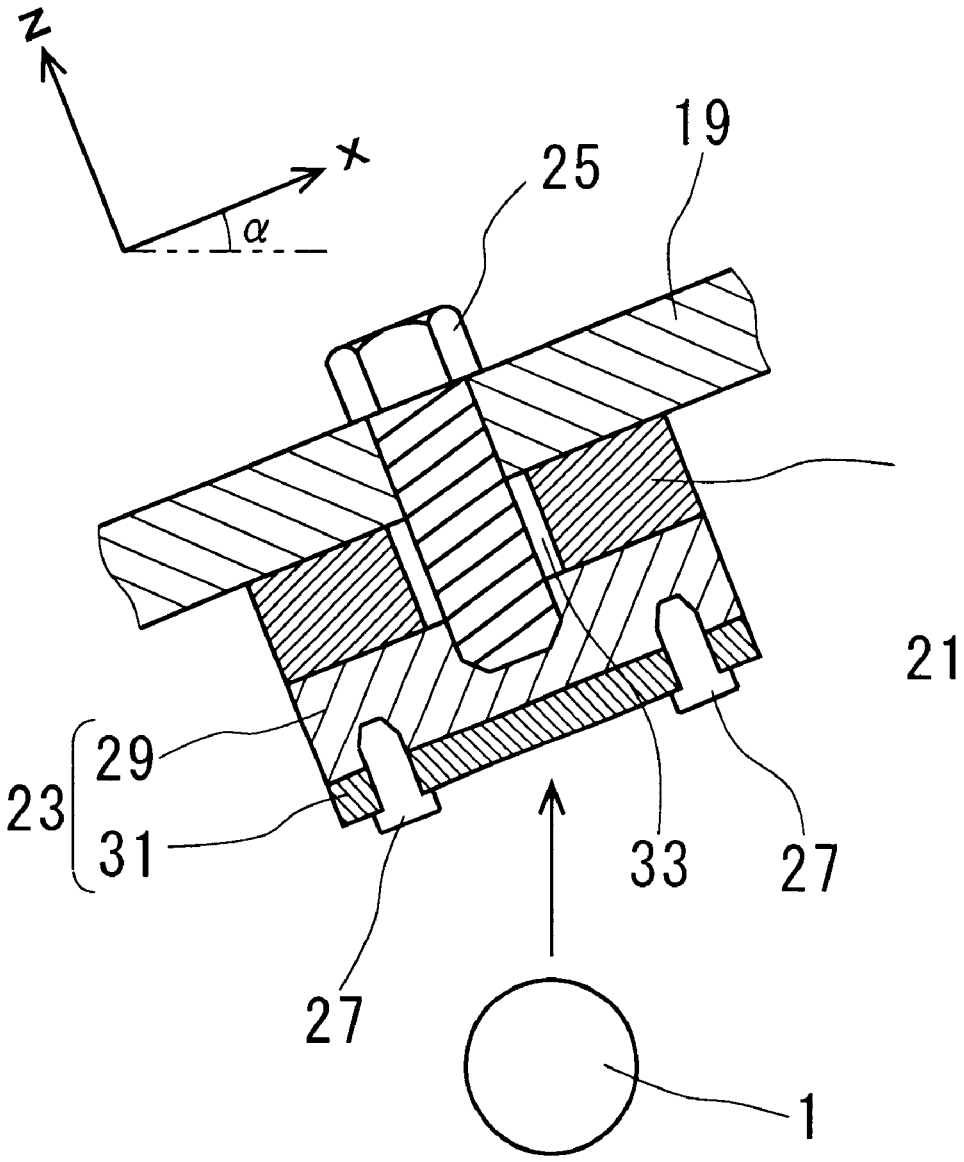
FIG. 2 is a partial sectional view showing a device for measuring a value of (T1/T2) of the golf ball illustrated in FIG. 1.

FIG. 2 is a partial sectional view showing a device for measuring a value of (T1/T2) of the golf ball 1 illustrated in FIG. 1. The device comprises a board 19, a load cell 21, a collision plate 23, a main bolt 25 and a small bolt 27. The collision plate 23 includes a body 29 and a covering plate 31. In FIG. 2, a z direction is obtained by a counterclockwise rotation of 22 degrees with respect to a vertically upward direction. An x direction is obtained by a counterclockwise rotation of 22 degrees with respect to a horizontally rightward direction. $\alpha$ represents 22 degrees to be an angle formed in a horizontal direction and the x direction. The board 19, the load cell 21 and the collision plate 23 are positioned to be extended in the x direction.

It is preferable that the board 19, the main bolt 25 and the small bolt 27 should be excellent in a strength and a rigidity and should be formed of any material. Usually, steel is used for the material. The board 19 has a thickness of 5.35 mm. The main bolt 25 has a type of M10 and the small bolt 27 has a type of M3 based on the JIS standard.

A three component force sensor (type 9067) produced by Kesler Co., Ltd. is used for the load cell 21. The sensor can measure components of forces in x, y (a perpendicular direction to the paper in FIG. 2) and z directions. The measurement is carried out through a connection of a charge amplifier (type 5011B produced by Kesler Co., Ltd.) (not shown) to the load cell 21. The load cell 21 has a through hole 33 provided on a center thereof. The main bolt 25 is inserted in the through hole 33.

The body 29 of the collision plate 23 is formed of stainless steel (SUS-630). The body 29 has a thickness of 15 mm. The planar shape of the body 29 is identical to that of the load cell 21 and is a square having a side of 56 mm. The tip of the main bolt 25 is screwed into the body 29. Consequently, the load cell 21 is interposed between the board 19 and the body 29 so that the position of the load cell 21 is fixed.

The covering plate 31 is fixed to the body 29 with two small bolts 27 and 27. The covering plate 31 is formed of a titanium alloy (6-4Ti) containing 6% by weight of aluminum and 4% by weight of vanadium. The covering plate 31 has a thickness of 2.5 mm. The planar shape of the covering plate 31 is identical to that of the load cell 21 and is a square having a side of 56 mm. The covering plate 31 is provided to maintain the state of a collision plane of the collision plate 23 to be constant. The covering plate 31 has a 10-point mean roughness Rz of 13.6 $\mu$m±2.0 $\mu$m.

When the value of (T1/T2) is to be measured by the device, the golf ball 1 is launched vertically upward and is caused to impact the almost central portion of the collision plate 23. Immediately before the impact, the golf ball 1 has a speed of 35 m/s±0.3 m/s. After the impact, the golf ball 1 rebounds in a rightward and downward direction in FIG. 2. During the impact, the Fn(t) to be time series data on force in the z direction and the Ft(t) to be time series data on force in the x direction are measured by the load cell 21. The measurement is carried out by sampling the data per frequency of 5000000 Hz. The sampled data are subjected to a smoothing processing through the calculation of a moving average for seven points. A time T1 is obtained from the measured Fn(t). The T1 represents a time taken after the start of the impact before the Fn(t) is first changed from a positive number to zero. A time T2 is obtained from the measured Ft(t). The T2 represents a time taken after the start of the impact before the Ft(t) is first changed from a positive number to a negative number.

Figure 3:
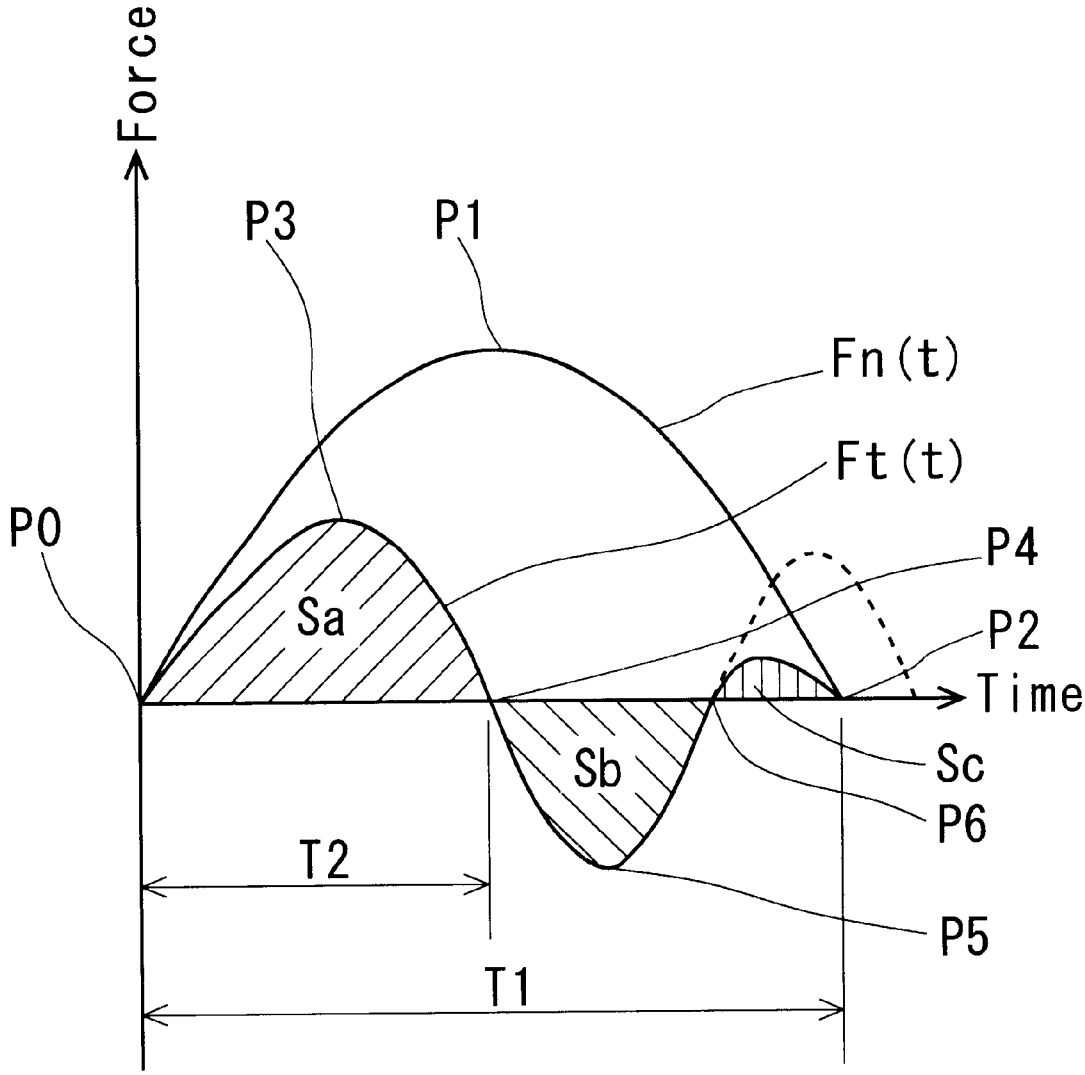
FIG. 3 is a graph showing an example of Fn(t) and Ft(t) measured by the device illustrated in FIG. 2.

FIG. 3 is a graph showing an example of the Fn(t) and the Ft(t) measured by the device illustrated in FIG. 2. An origin P0 of the graph is a position where the load cell 21 starts to sense force, and almost corresponds to a time at which the impact of the collision plate 23 on the golf ball 1 is started. The Fn(t) to be force in the z direction is gradually increased from the point P0 and has a maximum value at a point P1, and is then decreased gradually and has a value of zero at a point P2. At the point P2, the load cell 21 starts to sense no force and almost corresponds to a time at which the golf ball 1 goes away from the collision plate 23.

The Ft(t) to be force in the x direction (so-called tangential force) is gradually increased from the point P0 and has a maximum value at a point P3, and is then decreased gradually and has a negative value after a point P4. At a point P5, the Ft(t) has a minimum value and is gradually increased to have a positive value at a point P6 again. After the point P6, the tangential force applied to the golf ball 1 is represented by a curve shown in a dotted line of FIG. 3. The golf ball 1 goes away from the load cell 21 at the point P2. Therefore, the curve of the Ft(t) sensed by the load cell 21 is turned toward the point P2 as shown in a solid line and reaches zero on the point P2. An area Sa of a region shown in a rightward raised slant line which is surrounded by the curve of the Ft(t) and a time base represents an impulse having positive tangential force. An area Sb of a region shown in a leftward raised slant line which is surrounded by the curve of the Ft(t) and the time base represents an impulse having negative tangential force. Furthermore, an area Sc of a region shown in a vertical line which is surrounded by the curve of the Ft(t) and the time base represents an impulse having positive tangential force. Since the impulses Sa and Sc are obtained by force applied in the positive direction of an x axis, the force acts in such a direction that a back spin is promoted. On the other hand, since the impulse Sb is obtained by force applied in the negative direction of the x axis, the force acts in such a direction that the back spin is suppressed. As is apparent from FIG. 3, the sum of the impulses Sa and Sc is much greater than the impulse Sb. As the golf ball 1 has a greater value (hereinafter referred to as an "impulse difference") obtained by subtracting the impulse Sb from the sum of the impulses Sa and Sc, it has a higher back spin rate.

The T1 shown in FIG. 3 represents a time taken after the start of the impact before the Fn(t) is first changed from a positive number to zero, that is, a time from the point P0 to the point P2 as described above. The T2 represents a time taken after the start of the impact before the Ft(t) is first changed from a positive number to a negative number, that is, a time from the point P0 to the point P4 as described above.

The value of (T1/T2) is calculated from the T1 and T2 thus obtained. In the golf ball 1 shown in FIG. 1, the value of (T1/T2) is greater than 2.10 and is equal to or smaller than 2.50. The value is much greater than a value of (T1/T2) of the conventional golf ball 1, that is, approximately 1.8.

If the value of (T1/T2) is equal to or smaller than 2.10, the curve Ft(t) is shifted relatively rightwards with respect to the curve Fn(t). As a result, the impulse Sc is decreased and the impulse difference is also decreased so that the back spin rate is reduced. from this viewpoint, the value of (T1/T2) is preferably 2.20 or more, and more preferably, 2.30 or more. If the value of (T1/T2) is greater than 2.50, the impulse Sc is increased and the impulse difference is also increased so that the back spin rate is too increased. When the back spin rate is too high, a ratio at which a kinetic energy transmitted from the golf club to the golf ball 1 is consumed by the back spin is increased so that the flight distance of the golf ball 1 is extremely reduced. It is sufficient that each of the values T1 and T2 can achieve (T1/T2) which is greater than 2.10 and is equal to or smaller than 2.50. Usually, the T1 is 0.6 ms to 0.8 ms and the T2 is 0.3 ms to 0.4 ms.

The golf ball 1 having the value of (T1/T2) which is greater than 2.10 and is equal to or smaller than 2.50 can be obtained by causing a layer having a great modulus of elasticity to be provided comparatively on the outside. For example, if a modulus of elasticity in each layer is properly combined within a range shown in the following Table I in the golf ball 1 in which the first layer 7 has a diameter of 5 mm to 10 mm, each of the second layer 9 to the sixth layer 17 has a thickness of 1.0 mm to 3.0 mm and the cover 5 has a thickness of 1.5 mm to 3.0 mm, a value of (T1/T2) which is greater than 2.10 and is equal to or smaller than 2.50 can be achieved. An example of the combination will be described below in detail in the columns of "examples".

TABLE I

| Range of Modulus of Elasticity in Each Layer | |
|---|---|
| First layer | 20 to 60 MPa |
| Second layer | 25 to 70 MPa |
| Third layer | 35 to 100 MPa |
| Fourth layer | 40 to 140 MPa |
| Fifth layer | 80 to 200 MPa |
| Sixth layer | 120 to 300 MPa |
| Cover | 250 to 600 MPa |

As a matter of course, if a golf ball having a three-layer structure, a four-layer structure, a five-layer structure or a six-layer structure as well as the seven-layer structure includes a layer having a great modulus of elasticity which is provided comparatively on the outside, the value of (T1/T2) which is greater than 2.10 and is equal to or smaller than 2.50 can be achieved.

In this specification, the modulus of elasticity represents a complex modulus of elasticity E* measured in a compression mode by a visco-elasticity spectrometer produced by Rheology Co., Ltd. The measurement is carried out with an initial strain of 0.4 mm, a displacement amplitude of ±1.5 μm, a frequency of 10 Hz, a starting temperature of −70° C., an ending temperature of 110° C., and a temperature raising speed of 4° C./min. The modulus of elasticity is obtained based on a ratio of amplitudes and a difference in phase between a driving portion and a response portion at a temperature of 20° C. A specimen having a length of 4 mm, a width of 4 mm and a thickness of 2 mm is used for the measurement. The specimen is cut away from the golf ball 1. If the thickness of the layer is too small to cut the specimen away, a slab having a thickness of 2 mm is formed of a polymer composition having the same blending as that of the layer and a specimen is punched out of the slab. In the case in which a layer from which the specimen cannot be cut out is formed of a crosslinked rubber, a rubber composition having the same blending as that of the layer is put in a mold including a cavity having a thickness of 2 mm and is crosslinked at a crosslinking temperature of 160° C. for a crosslinking time of 30 minutes so that the slab is obtained. In the case in which the layer from which the specimen cannot be cut out is formed of a synthetic resin composition, a synthetic resin composition having the same blending as that of the layer is injected into the mold including the cavity having a thickness of 2 mm so that the slab is formed.

The golf ball 1 having a value of (T1/T2) which is greater than 2.10 and is equal to or smaller than 2.50 can be obtained by causing a layer having a great modulus of elasticity to be provided comparatively on the outside as described above. In order to obtain the golf ball 1 having such a distribution of the modulus of elasticity, the following means can be used.

(1) An outer layer of the core 3 is caused to have a higher hardness than that of an inner layer.

(2) A synthetic resin to be used for the cover 5 has a high rigidity.

(3) A thickness of the cover 5 is increased.

(4) An intermediate layer having a higher rigidity than that of the core 3 is provided between the cover 5 and the core 3.

(5) The outer layer of the core 3 has a higher specific gravity than that of the inner layer.

(6) A material having a high specific gravity is used for the cover 5.

(7) The inner layer of the core 3 is formed of a foam.

Referring to the golf ball 1, the modulus of elasticity of the cover 5 is preferably 200 MPa or more, more preferably, 300 MPa or more, and most preferably 350 MPa or more. If the modulus of elasticity is less than the above-mentioned range, the surface of the golf ball 1 is easily damaged during the hitting in some cases. In order to prevent the damage, it is preferable that the modulus of elasticity of the cover 5 should be greater. If the modulus of elasticity is too great, the hitting feeling is deteriorated. Therefore, the modulus of elasticity is preferably 450 MPa or less, and more preferably, 410 MPa or less.

In the golf ball 1, the amount of compressive deformation of the core 3 is preferably 3.0 mm or more, more preferably 3.6 mm or more, and most preferably 3.75 mm or more. If the amount of compressive and deformation is less than the above-mentioned range, the hitting feeling becomes poor in some cases. In order to prevent the poor hitting feeling, it is preferable that the amount of compressive deformation of the core 3 should be larger. If the amount of compressive deformation of the core 3 is too large, the hitting feeling is deteriorated, and furthermore, the durability of the golf ball 1 is also reduced. Therefore, it is preferable that the amount of compressive deformation should be 4.0 mm or less, particularly, 3.9 mm or less. The amount of compressive deformation implies the amount of deformation of the core from a stage in which an initial load of 98 N is applied to the core 3 to a stage in which the load is gradually increased and a final load of 1274 N is applied.

EXAMPLES

Example 1

100 parts by weight of high-cis polybutadiene (trade name of "BR01" produced by JSR Corporation), 16.3 parts by weight of zinc acrylate, 24.4 parts by weight of zinc oxide and 1.0 part by weight of dicumyl peroxide (trade name of "Percumyl D" produced by NOF corporation) were kneaded by means of an internal kneading machine and a rubber composition was prepared (blending indicated as J in the following Table III). The rubber composition was put in a mold including upper and lower parts having hemispherical cavities respectively and was crosslinked for 20 minutes at a temperature of 160° C. Consequently, a first layer having a diameter of 6.4 mm was obtained. The first layer had a modulus of elasticity of 38.2 MPa.

Next, a rubber composition indicated as J in the following Table III was put in a mold including a hemispherical cavity having a great inside diameter, and furthermore, an insert core having the same outside diameter as that of the first layer was put therein and the mold was closed. Then, the rubber composition was heated for 20 minutes at a temperature of 160° C. so that a semi-crosslinked half shell was formed. The mold was opened and the insert core was taken out, and the first layer was put in the cavity of the half shell. Furthermore, the mold was closed and the rubber composition was crosslinked for 20 minutes at a temperature of 160° C. Thus, a second layer was formed. The second layer has a thickness of 3.2 mm.

Each layer was sequentially formed repetitively by such a semi-crosslinking half shell method. Consequently, third to sixth layers having a thickness of 3.2 mm were formed and a core was obtained. In this case, a rubber composition indicated as H in the following table III was used for the third and fourth layers and a rubber composition indicated as C was used for the fifth and sixth layers. The type of the rubber composition used in each layer and the modulus of elasticity in each layer are shown in the following Table II.

On the other hand, 50 parts by weight of ionomer resin (ethylene/methacrylic acid copolymer neutralized with sodium ions) (trade name of "Himilan 1605" produced by Du Pont-Mitsui Polychemicals Company, Ltd.), 50 parts by weight of ionomer resin (ethylene/methacrylic acid copolymer neutralized with zinc ions) (trade name of "Himilan 1706" produced by Du Pont-Mitsui Polychemicals Company, Ltd.) and 2 parts by weight of titanium dioxide were blended to prepare a resin composition (blending indicated as Q in the following Table IV). Then, a core was put in a mold including upper and lower parts having hemispherical cavities respectively, and the resin composition was injected around the core. Thus, a cover having a thickness of 2.2 mm was formed. The cover had a modulus of elasticity of 343.1 MPa. The cover was preprocessed by a conventional method, and furthermore, was subjected to coating. Thus, a golf ball according to the example 1 was obtained.

Examples 2 to 4 and Comparative Examples 1 to 3

Golf balls according to examples 2 to 4 and comparative examples 1 to 3 were obtained in the same manner as in the example 1 except that a rubber composition for each layer of a core and a resin composition for a cover which are shown in the following Table II were used. Each rubber composition is blended as shown in the following Table III. Moreover, each resin composition is blended as shown in the following Table IV. The type of the rubber composition used for each layer of the golf ball and a modulus of elasticity in each layer are shown in the following Table II.

Measurement of Amount of Compressive Deformation of Core

The amount of compressive deformation of the core was measured by the above-mentioned method. The result of the measurement is shown in the following Table II.

Measurement of (T1/T2)

A value of (T1/T2) of the golf ball according to each of the examples and the comparative examples was measured by the above-mentioned method. The result of the measurement is shown in the following Table II.

Hitting Test 10 golf balls according to each of the examples and the comparative examples were prepared. On the other hand, a No. 3 iron (trade name of "HI-BRID AUTOFOCUS" produced by Sumitomo Rubber Industries, Ltd.) was attached to a swing robot produced by True Temper Co. and the conditions of a machine were adjusted to set a head speed of 38.8 m/s. Then, each golf ball was hit to measure a back spin rate and a launch angle which are obtained immediately after the hitting. Moreover, the hit golf ball was caused to fall into the green and a run (a distance between a falling point and a ball rest point) was measured. The following Table II shows the result of calculation of a mean value for 10 data in each of the examples and comparative examples.

[Evaluation of Chanking Resistance]

Two advanced amateur golf players hit the golf ball according to each of the examples and the comparative examples with a sand wedge (trade name of "HI-BRID AUTOFOCUS" produced by Sumitomo Rubber Industries, Ltd.). The hitting was repeated four times with a variation in a hitting point for one golf ball. The degree of damage on the surface of the golf ball was visually decided. Little damage on the surface is indicated as "○", slight damage on the surface which can be seen and found very carefully is indicated as "Δ", and great damage which can be decided very easily is indicated as "X". The result of the evaluation is shown in the following Table II.

[Evaluation of Hitting Feeling]

Each of two advanced amateur golf players hit four golf balls according to each of the examples and the comparative examples with a driver (trade name of "HI-BRID AUTO-FOCUS W#1" produced by Sumitomo Rubber Industries, Ltd.). A hitting feeling was evaluated in five stages of "1" to "5". The best hitting feeling is indicated as "5" and the worst hitting feeling is indicated as "1". A mean value of the result of the evaluation is shown in the following Table II.

TABLE II

Result of Evaluation of Golf ball

| | | Comparative Example 1 | Comparative Example 2 | Comparative Example 3 | Example 1 | Example 2 | Example 3 | Example 4 |
|---|---|---|---|---|---|---|---|---|
| Blending Type-Modulus of elasticity (MPa) | 1st layer | D-119.7 | D-119.7 | C-142.5 | J-38.2 | K-35.0 | K-35.0 | K-35.0 |
| | 2nd layer | D-119.7 | D-119.7 | C-142.5 | J-38.2 | K-35.0 | K-35.0 | K-35.0 |
| | 3rd layer | E-112.3 | D-119.7 | C-142.5 | H-60.8 | I-40.1 | I-40.1 | I-40.1 |
| | 4th layer | E-112.3 | D-119.7 | C-142.5 | H-60.8 | H-60.8 | H-60.8 | H-60.8 |
| | 5th layer | F-104.9 | D-119.7 | C-142.5 | C-142.5 | B-153.2 | B-153.2 | B-153.2 |
| | 6th layer | G-97.4 | D-119.7 | C-142.5 | C-142.5 | B-153.2 | B-153.2 | A-210.8 |
| | cover | Q-343.1 | Q-343.1 | R-285.1 | Q-343.1 | Q-343.1 | P-402.5 | P-402.5 |
| (T1/T2) | | 1.75 | 1.84 | 1.75 | 2.20 | 2.31 | 2.42 | 2.50 |
| Back spin rate (rpm) | | 3690 | 3662 | 3705 | 3740 | 3796 | 3880 | 3940 |
| Launch angle (degree) | | 12.0 | 12.5 | 11.9 | 11.9 | 11.8 | 11.7 | 11.6 |
| Run (m) | | 10.0 | 9.5 | 9.9 | 7.2 | 6.8 | 6.1 | 5.8 |
| Chanking Resistance | | Δ | Δ | X | Δ | Δ | ○ | ○ |
| Hitting Feeling | | 2 | 2 | 1 | 3 | 4 | 4.5 | 4.8 |

TABLE III

Blending of Rubber Composition used for Each Layer of Core

| | A | B | C | D | E | F | G | H | I | J | K |
|---|---|---|---|---|---|---|---|---|---|---|---|
| Polybutadiene | 100 | 100 | 100 | 100 | 100 | 100 | 100 | 100 | 100 | 100 | 100 |
| Zinc acrylate | 35.0 | 30.0 | 28.4 | 26.5 | 25.0 | 23.5 | 22.0 | 20.5 | 8.0 | 16.3 | 15.3 |
| Zinc oxide | 17.6 | 19.5 | 20.0 | 20.8 | 21.3 | 21.9 | 22.5 | 23.0 | 27.5 | 24.4 | 24.7 |
| Dicumyl peroxide | 1.0 | 1.0 | 1.0 | 1.0 | 1.0 | 1.0 | 1.0 | 1.0 | 1.0 | 1.0 | 1.0 |
| Modulus of elasticity (MPa) | 210.8 | 153.2 | 142.5 | 119.7 | 112.3 | 104.9 | 97.4 | 60.8 | 40.1 | 38.2 | 35.0 |

TABLE IV

Blending of Resin Composition used for Cover

| | P | Q | R |
|---|---|---|---|
| Himilan 1605 | — | 50.0 | 35.0 |
| Himilan 1706 | — | 50.0 | 35.0 |
| Himilan 1855 | — | — | 30.0 |
| Himilan AM7315 | 50.0 | — | — |
| Himilan AM7318 | 50.0 | — | — |
| Titanium dioxide | 2.0 | 2.0 | 2.0 |
| Modulus of elasticity (MPa) | 402.5 | 343.1 | 285.1 |

Himilan 1855: ionomer resin (ethylene/methacrylic acid/acrylic acid ester copolymer neutralized with zinc ion) produced by Du Pont-Mitsui Polychemicals Company, Ltd.

Himilan AM7315: ionomer resin (ethylene/methacrylic acid copolymer neutralized with zinc ion) produced by Du Pont-Mitsui Polychemicals Company, Ltd.

Himilan AM7318: ionomer resin(ethylene/methacrylic acid copolymer neutralized with zinc ion produced by Du Pont-Mitsui Polychemicals Company, Ltd.

In the Table II, the golf ball according to each example has a higher spin rate and a smaller run than those of the golf ball according to each comparative example. Based on the result of the evaluation, the advantage of the present invention was apparent.

While the present invention has been described in detail by taking a solid golf ball having a multilayered structure as an example, a golf ball comprising a thread wound core can produce the effect of enhancing a spin performance if a value of (T1/T2) is greater than 2.10 and is equal to or smaller than 2.50.

The above description is only illustrative and various changes can be made without departing from the scope of the invention.

What is claimed is:

1. A golf ball comprising:

a core, wherein said core is formed by crosslinking a rubber composition, wherein said rubber composition comprises a base rubber, a co-crosslinking agent, organic peroxide and a filler; and a cover formed of a synthetic resin, wherein the modulus of elasticity of said cover is from 200 to 450 MPa;

wherein the amount of compressive deformation of the core is larger than 3.6 mm; and a value of (T1/T2) is greater than 2.10 and is equal to or smaller than 2.50, wherein a direction of a counterclockwise rotation by 22 degrees with respect to a vertically upward direction is set to be a z direction, a direction of a counterclockwise rotation by 22 degrees with respect to a horizontally rightward direction is set to be an x direction, time series data on forces in the z and x directions which are applied to a load cell provided on a back face of a collision plate having a surface extended in the x direction when the golf ball impacts the collision plate in the vertically upward direction at a speed of 35 m/s are represented by Fn(t) and Ft(t) respectively, a time taken after a start of the impact before the Fn(t) is first changed from a positive number to zero is represented by said T1, and a time taken after the start of the impact before the Ft(t) is first changed from a positive number to a negative number is represented by said T2.

2. The golf ball of claim 1, wherein said core comprises a first spherical layer and a second layer surrounding said first layer, wherein the modulus of elasticity for said first layer is 20 to 60 MPa and the modulus of elasticity for said second layer is 25 to 70 MPa.

3. The golf ball of claim 2, wherein wherein the thickness of said first layer is 5 mm to 10 mm, the thickness of said second layer is 1.0 mm to 3.0 mm, and the thickness of said cover is 1.5 mm to 3.0 mm.

4. The golf ball of claim 2, further comprising a third layer surrounding said second layer, wherein the modulus of elasticity for said third layer is 35 to 100 MPa.

5. The golf ball of claim 4, wherein the thickness of said third layer is 1.0 mm to 3.0 mm.

6. The golf ball of claim 4, further comprising a fourth layer surrounding said third layer, wherein the modulus of elasticity for said fourth layer is 40 to 140 MPa.

7. The golf ball of claim 6, wherein the thickness of said fourth layer is 1.0 mm to 3.0 mm.

8. The golf ball of claim 6, further comprising a fifth layer surrounding said fourth layer, wherein the modulus of elasticity for said fifth layer is 80 to 200 MPa.

9. The golf ball of claim 8, wherein the thickness of said fifth layer is 1.0 mm to 3.0 mm.

10. The golf ball of claim 8, further comprising a sixth layer surrounding said fifth layer, wherein the modulus of elasticity for said sixth layer is 120 to 300 MPa.

11. The golf ball of claim 10, wherein the thickness of said sixth layer is 1.0 mm to 3.0 mm.

12. The golf ball of claim 1, wherein said value of (T1/T2) is from 2.20 to 2.50.

13. The golf ball of claim 1, wherein said value of (T1/T2) is from 2.20 to 2.42.

14. The golf ball of claim 2, wherein the modulus of elasticity for said cover is 350 to 450 MPa.

15. The golf ball of claim 2, wherein each of said first and second layers comprises polybutadiene.

* * * * *